US011078904B2

(12) United States Patent
Bornemann et al.

(10) Patent No.: US 11,078,904 B2
(45) Date of Patent: Aug. 3, 2021

(54) FLUID PUMP

(71) Applicant: GKN Sinter Metals Engineering GmbH, Radevormwald (DE)

(72) Inventors: Nils Bornemann, Bonn (DE); Stefan Tiller, Sankt Augustin (DE); Antonio Casellas, Siegburg (DE); Ümit Aydin, Wachtberg (DE)

(73) Assignee: GKN Sinter Metals Engineering GmbH, Radevormwald (DE)

( * ) Notice: Subject to any disclaimer, the term of this patent is extended or adjusted under 35 U.S.C. 154(b) by 147 days.

(21) Appl. No.: 15/569,708

(22) PCT Filed: Apr. 28, 2016

(86) PCT No.: PCT/EP2016/059549
§ 371 (c)(1),
(2) Date: Oct. 26, 2017

(87) PCT Pub. No.: WO2016/174164
PCT Pub. Date: Nov. 3, 2016

(65) Prior Publication Data

US 2018/0128268 A1 May 10, 2018

(30) Foreign Application Priority Data

Apr. 28, 2015 (DE) ..... 10 2015 207 748.9

(51) Int. Cl.
*F04C 2/10* (2006.01)
*F04C 15/00* (2006.01)

(52) U.S. Cl.
CPC ..... *F04C 2/102* (2013.01); *F04C 15/008* (2013.01); *F04C 2240/40* (2013.01)

(58) Field of Classification Search
CPC .... F04C 2/02; F04C 2/10; F04C 2/063; F04C 2/102; F04C 11/008; F04C 15/008;
(Continued)

(56) References Cited

U.S. PATENT DOCUMENTS

| | | | | |
|---|---|---|---|---|
| 5,145,329 | A | 9/1992 | Zumbusch et al. | |
| 6,441,530 | B1 * | 8/2002 | Petersen | H02K 1/146 310/216.001 |
| 2012/0216654 | A1 | 8/2012 | Schmitt et al. | |

FOREIGN PATENT DOCUMENTS

| | | | |
|---|---|---|---|
| JP | H08134509 | A | 5/1996 |
| WO | 2006021616 | A1 | 3/2006 |
| WO | 2011035858 | A1 | 3/2011 |

OTHER PUBLICATIONS

Henry IV, et al., "Integrated Motor/Gear Pump" (US H1996 H), Jun. 2001 (Year: 2001).*

(Continued)

*Primary Examiner* — Kenneth J Hansen
(74) *Attorney, Agent, or Firm* — Quarles & Brady LLP

(57) ABSTRACT

The invention relates to a fluid pump, driven by means of an electric motor, which is coupled to a pump rotor of the fluid pump, wherein the electric motor is an axial-flux electric motor, the electric-motor rotor of which is also the pump rotor, and the pump rotor and the electric-motor rotor are accommodated in a common housing, in which the pump rotor and the electric-motor rotor rotate while integrated as combination rotor in a disk shape, wherein the common housing has a fluid inlet and a fluid outlet to the combination rotor. The invention further relates to a production method for such a fluid pump.

11 Claims, 6 Drawing Sheets

Figure 1A:
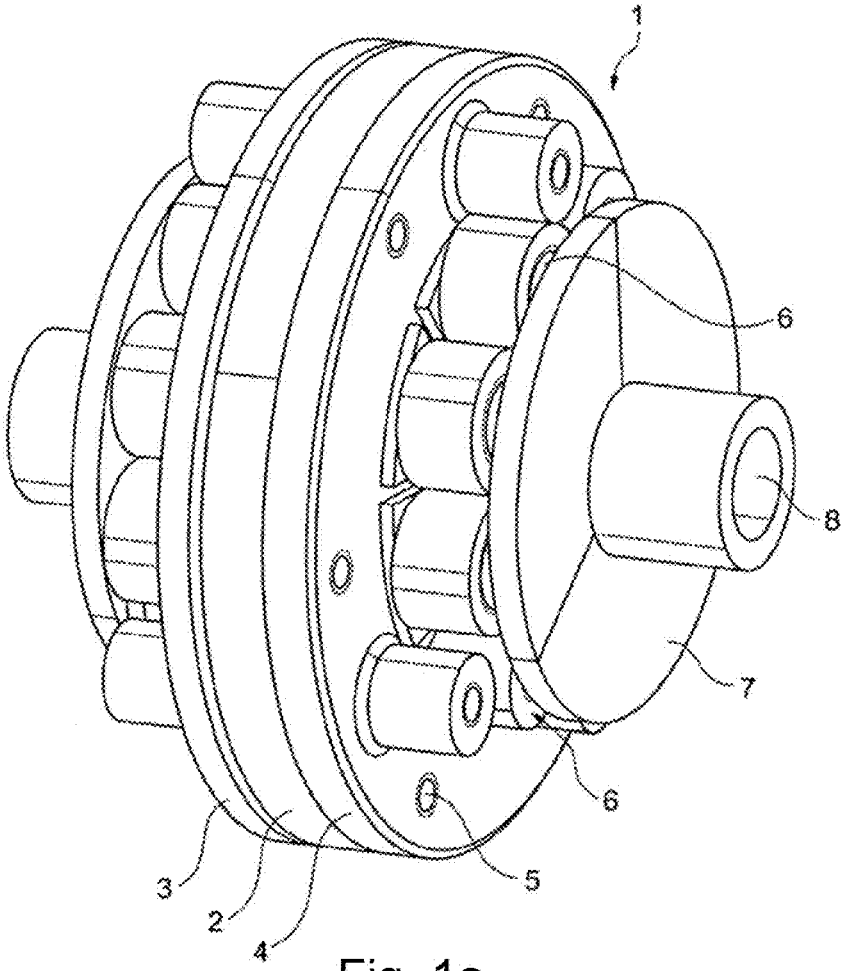

(58) Field of Classification Search
CPC .. F04C 2240/30; F04C 2240/40; F04B 17/00; H02K 1/2793; H02K 21/24; H02K 21/38
See application file for complete search history.

(56) References Cited

OTHER PUBLICATIONS

US H1966 (H), Integrated Motor/Gear Pump, Inventor: John W. Henry IV, et al., Jun. 5, 2001.
PCT International Search Report, PCT/EP2016/059549, dated Jul. 14, 2016.

* cited by examiner

FLUID PUMP

This application represents the U.S. national stage entry of International Application No. PCT/EP2016/059549 filed Apr. 28, 2016, which claims priority to German Patent Application No. 10 2015 207 748.9 filed Apr. 28, 2015, the disclosure of which is incorporated herein by reference in its entirety and for all purposes.

The present invention relates to a fluid pump which is driven with an electric motor, wherein a pump rotor is coupled to the electric motor.

WO 2006/021616 A1 discloses an electric machine with an axial electric motor. A rotor of the electric machine is arranged between two stators which are each arranged laterally, which rotor has, along its circumference, guiding elements which are embedded in a non-ferromagnetic material of the rotor.

The object of the present invention is to make available a particularly leak-proof fluid machine which can reliably transport different media, in particular even aggressive media.

The object is achieved with a fluid pump having the features of claim 1 and with a method having the features of claim 10. Advantageous developments and embodiments can be found in the following dependent claims, description and figures. The individual features of individual embodiments are, however, not restricted thereto. Instead, one or more features from one or more embodiments can be linked to one or more features of another embodiment. Furthermore, the formulation of the two independent claims is respectively a first attempt to describe the subject matter of the invention. The invention itself becomes apparent from the entire disclosure, for which reason one or more features of the independent claims can also be expanded, replaced or even deleted.

A fluid pump is proposed which is driven by an electric motor which is coupled to a pump rotor of the fluid pump, wherein the electric motor is an axial flux electric motor, the electric motor rotor of which is also the pump rotor, and the pump rotor and the electric motor rotor are accommodated in a common housing in which the pump rotor and the electric motor rotor rotate in an integrated fashion in the shape of a disk as a combination rotor, wherein the common housing has a fluid inflow and a fluid outflow to and from the combination rotor.

As claimed in a development, there is provision that a pump chamber and magnets of the electric motor, which are oriented axially with respect to the rotational axis of the combination rotor, are arranged extending from said rotational axis when viewed in a radial direction. This permits the formation of field lines in the axial direction, with the result that a torque can be impressed on the combination rotor.

An embodiment provides that in the combination rotor, a multiplicity of axially oriented magnets are distributed along a circumference of the combination rotor. The magnets can be arranged near an external circumference or else near to an internal circumference of the combination rotor here. As an alternative to the magnets, soft-magnetic elements can also be used. Wherever the term magnets is used below, the statements in this regard therefore also apply to the use of soft-magnetic elements, as are used, for example, in a reluctance motor. The magnets or soft-magnetic elements can have different geometries. They can be cylinders, as cake-segment-shaped sections or with some other geometry. They can also result in a closed ring which forms a part of a combination rotor.

For example there is provision that at least one stator of the electric motor is arranged at an end side with respect to the combination rotor, wherein cores of the stator, which are oriented axis-parallel with respect to the rotational axis of the rotor, have at least partially a soft-magnetic material. A multiplicity of cores, preferably at least five cores, are arranged distributed in an axially oriented fashion around the circumference.

It is preferred that a first stator of the axial flux motor surrounds the combination rotor on a first end side, and a second stator of the axial flux motor surrounds the combination rotor on a second end side, opposite the first end side, of the common housing. This permits, on the one hand, a particularly compact design, and, on the other hand, also the generation of a relatively strong torque.

A development provides that cores of the first stator and of the second stator lie precisely opposite one another, axis-parallel with respect to the rotational axis of the rotor. This arrangement has the advantage, for example, of directly amplifying the respectively acting electromagnetic forces.

In turn, an embodiment provides that cores of the first stator and of the second stator lie opposite one another, offset with respect to one another and axis-parallel with respect to the rotational axis of the rotor. In this way field lines which are, for example, distributed more widely axially around the circumference can be generated.

It is preferred if the common housing has a nonmagnetic material, at least in a region between the rotating combination rotor and the cores of the stator. As a result, the necessary formation of the electromagnetic field for the generation of a torque at the combination rotor is not disrupted, or is only slightly disrupted.

Furthermore, it is preferred that a pump chambers closed off in the common housing, and the fluid inflow and/or the fluid outflow to and from the pump chamber preferably occurs axially along the rotational axis, in particular preferably through the electric motor.

For example, there can be provision that the combination rotor has a pump wheel which rotates along, wherein a shaft of the combination rotor is arranged and mounted inside the common housing.

An embodiment provides that the combination rotor rotates about a rotational axis in the common housing, wherein a pump wheel which rotates along is seated on the rotational axis. The combination rotor and the pump wheel can have the same rotational axis or can use different rotational axes which are arranged in parallel with respect to one another.

A further embodiment provides, in turn, that a first and a second end of the shaft or of the rotational axis of the combination rotor respectively end in the common housing.

The common housing preferably only has static seals, but on the other hand it does not have any seal on the basis of a relative movement between a fixed part of the common housing and a component which is made to extend outward and is moved with respect thereto. Instead, a component which can move relative to the common housing, such as a shaft, can be dispensed with. An axle for the combination rotor can be made to extend out of the common housing, for example at least on one side. If an aggressive fluid is to be conveyed by means of the fluid pump, dispensing with a dynamically stressed seal permits for example a longer service life of the fluid pump.

As claimed in a further concept of the invention, which is used together with the fluid pump which is described both above and below, a method for manufacturing a fluid pump is proposed having the following steps:

manufacturing a combination rotor as a pump rotor and an electric motor rotor of a disk design with axial arrangement of magnets or soft-magnetic elements in the combination rotor, insertion of the combination rotor into an outer ring, insertion of a shaft or axle, lateral attachment of at least one side wall to the outer ring to provide fluid-tight sealing of the combination rotor with the accommodation of an end of the shaft or axle in the side wall, lateral attachment of at least one stator of an electric motor to the side wall in order to drive the combination rotor in the common housing formed by means of at least the outer ring and side wall, wherein cores of the stator are arranged axis-parallel with respect to the rotational axis of the combination rotor.

A development of the method provides that the cores of the stator are pressed and manufactured from a soft-magnetic material.

There is the possibility of the common housing also being manufactured as a second component, by means of a pot-shaped first component and a side cover which is to be attached thereto. As a result, a bearing for a shaft of the combination rotor can be provided in a base of the first component, the counter piece of which shaft is arranged, for example, in the side cover. It is preferably possible to use axial bearings, but also axial/radial bearings, in particular roller bearings. Bearings are preferably used which have lubrication over their service life.

Figure 1B:
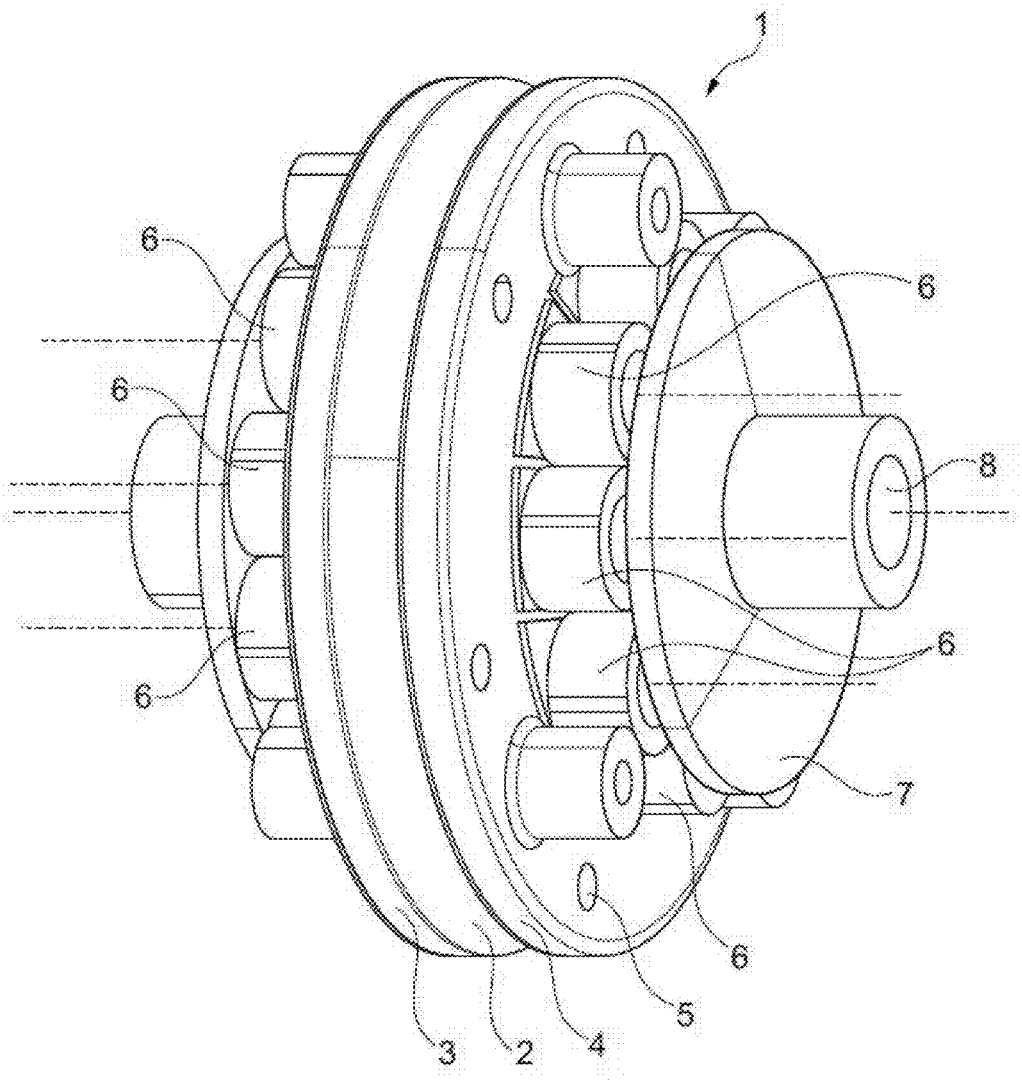
Figure 2:
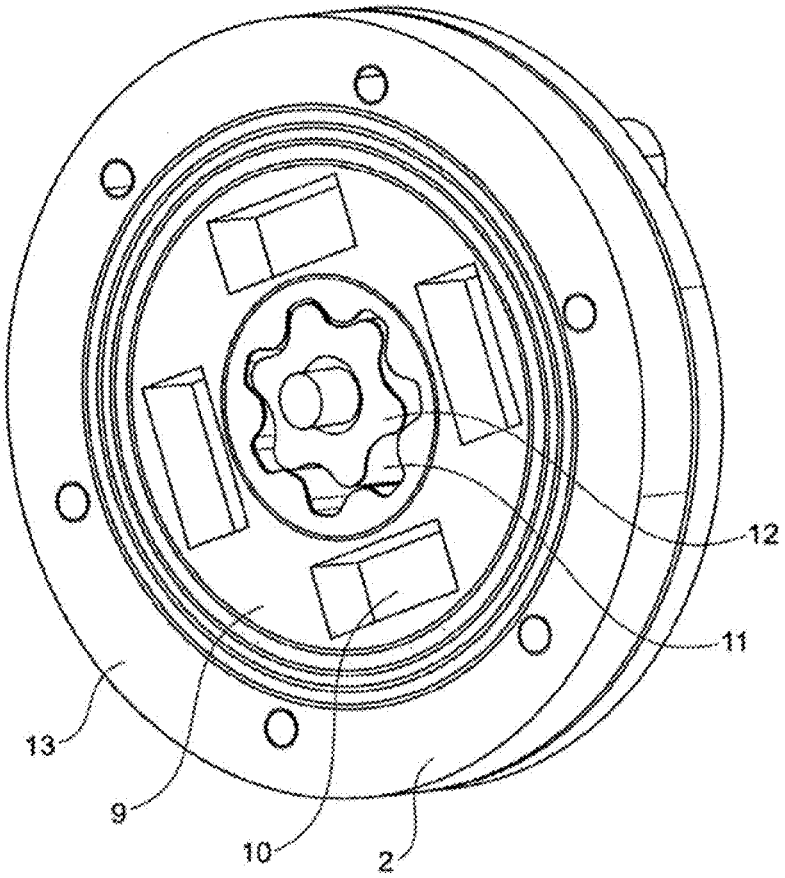
Figure 3:
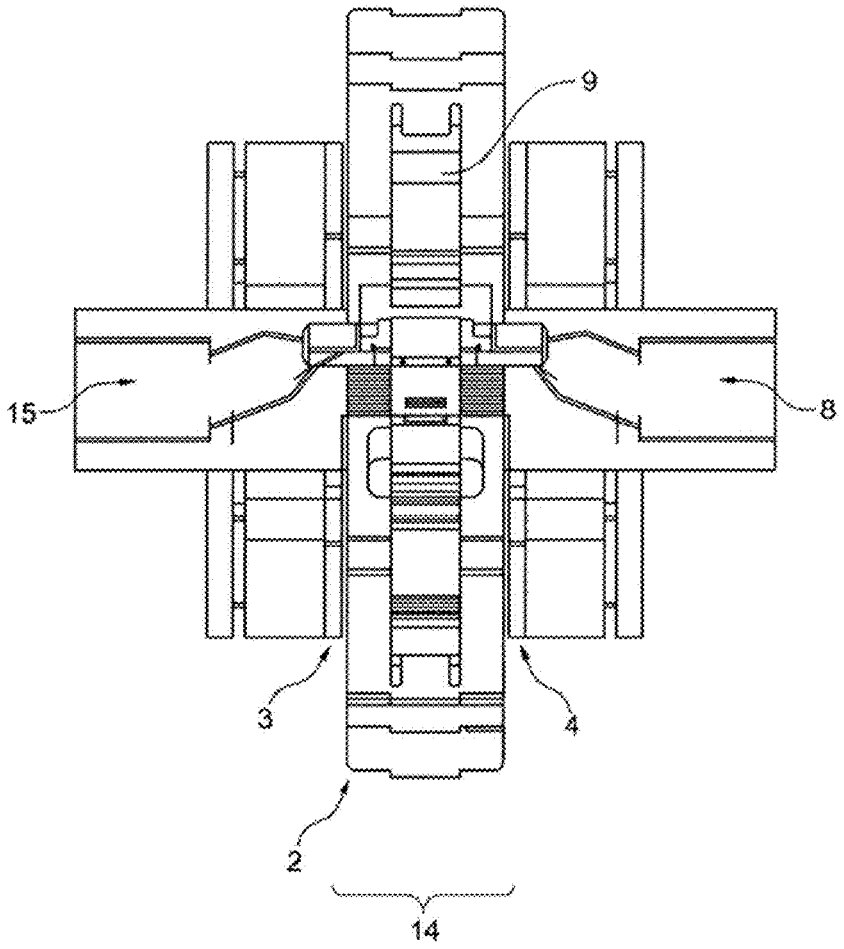
Figure 4:
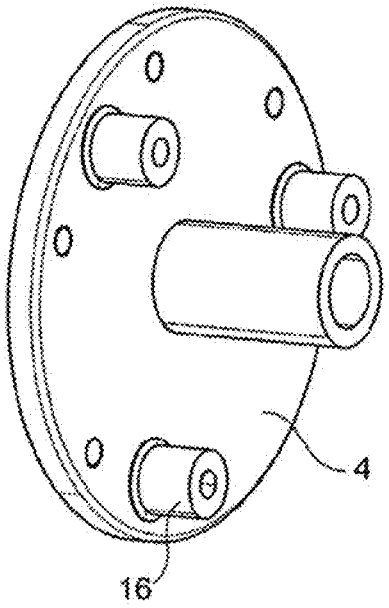
Figure 5:
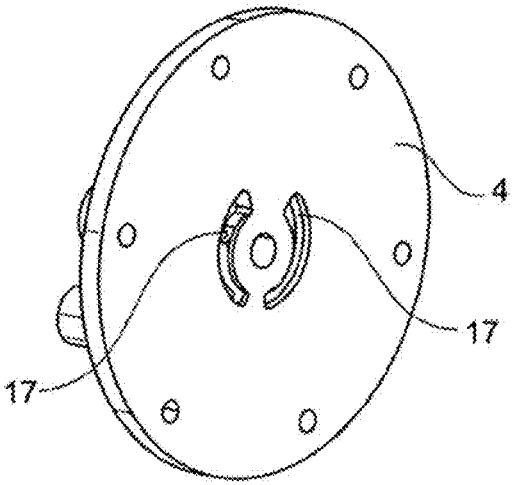
Figure 6:
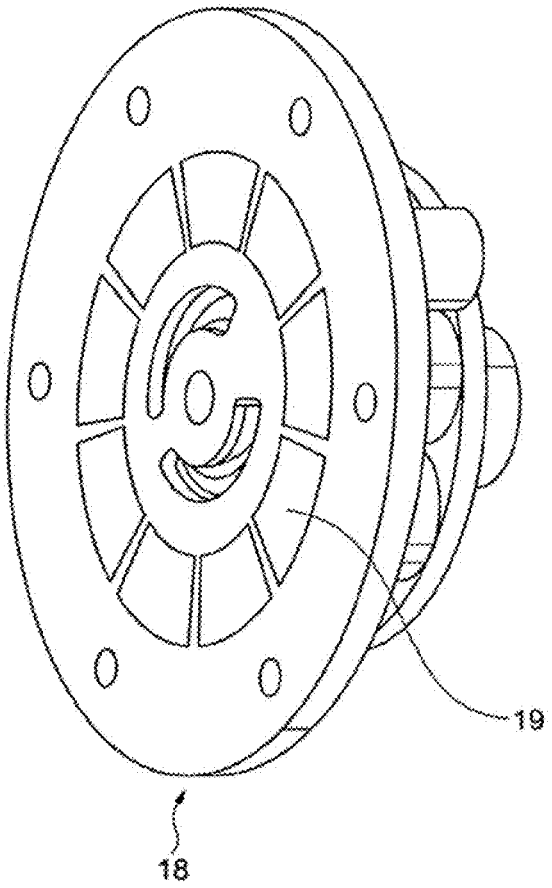

The following figures show in an exemplary fashion various embodiments of the invention for the purpose of exemplary illustration, without the invention being limited thereto. Instead, one or more features from one embodiment can be combined with other features from the description as well as from the other figures to form further embodiments including embodiments which are also not illustrated figuratively in more detail. In the drawings:

FIGS. 1*a* and 1*b* show exemplary embodiments of a fluid pump with the cores of the first stator and the second stator axially aligned and axially offset, respectively, FIG. 2 shows an internal view of the fluid pump from FIG. 1*a*, FIG. 3 shows a sectional view through the fluid pump from FIG. 1*a*, FIG. 4 shows an oblique view of a side cover with inlet connecting elements, FIG. 5 shows a further oblique view of the side cover from FIG. 4, and FIG. 6 shows a further embodiment of a side cover.

FIGS. 1*a* and 1*b* show views of a fluid pump 1 in an assembled state, only differing from one another in that they illustrate the axial alignment or axial offset of the cores, respectively. An inner housing 2 is connected to a first and second side cover 3, 4 preferably connected in a repeatedly detachable fashion. This can be done, for example, by means of a screw connection through holes 5. These are distributed around the circumference, as a result of which a seal of a pump chamber in the inner housing 2 is made possible. The first and second side covers 3, 4 have stator cores 6 which are each oriented running axially with respect to a rotor axle in the interior of the inner housing 2. A winding is wrapped around each of the stators cores 6, with the result that an electromagnetic field can be generated. For this purpose, for example a circuit board can be arranged on a cover 7, which permits the respective windings and actuation means thereof to be connected. For example a liquid can be fed centrally via a feed line as a fluid inflow 8 centrally via the cover 7. However, there is also the possibility for a fluid to be fed and discharged laterally.

FIG. 2 shows in an exemplary embodiment an inner housing 2 with a combination rotor 9 which is arranged internally. The combination rotor rotates in the inner housing 2. The combination rotor 9 can have recesses 10, into which, for example, magnets or soft-magnetic elements can be inserted. A pump chamber 11 is located in an interior space of the combination rotor 9. A gerotor 12 is located in the pump chamber. Instead of a gerotor as a fluid pump, an impeller wheel pump, an impeller vane pump, a P rotor, a roller vane pump, a rotary vane pump or else a radial piston pump can also be arranged in the inner housing 2. In this context, the respective pump wheel can either be a component of the combination rotor or can be arranged on an axle as in the case of the illustrated gerotor and can also rotate around it.

The combination rotor 9, which is at the same time also the rotor of the electric motor, can have permanent magnets or else soft-magnetic elements, for example in the recesses 10. It is therefore possible to form a permanently excited synchronous or brushless DC motor, abbreviated as BLDC, with permanent magnets as the axial flux electric motor, while, for example, a reluctance motor can be provided with an axial design, for example with soft-magnetic elements. A stator which is arranged on the rear side of the illustrated inner housing 2 because of the position can have a soft-magnetic material, for example, a Soft Magnetic Composite, abbreviated as SMC, or a combination of electrical sheets and SMC.

An internal circumferential surface 13 of the inner housing 2 can be finely worked in such a way that it forms a seal with a side cover. However, the internal circumferential surface 13 can also have an additional seal which interacts in a seal-forming fashion with a complementary side of the side cover.

FIG. 3 shows a sectional view of the fluid pump 1 in FIG. 1*a* in a sectional view. The inner housing 2, together with the respective first and second side covers 3, 4, form a sealed-off, common housing 14 in which a pump wheel is driven by means of the combination rotor 9. The illustration shows the disk-shaped geometry of the combination rotor 9. In this embodiment, the common housing 14 has the axially arranged fluid inflow 8 and a fluid outflow 15 arranged axially opposite the latter. The fluid inflow 8 can for this purpose conduct a fluid to the pump wheel in the second side cover by means of a lateral cutout, to the gerotor. In the first side cover 3, the fluid outflow 15 can open into the pump chamber, again opposite, or as in some types of pump, offset with respect to the latter. It is also possible to conduct the fluid radially.

FIG. 4 shows the second side cover 4 from FIG. 1*a* with connecting elements 16 fitted thereon, from a lateral perspective. The connecting elements 16 permit, for example, the axial pump which is formed in this way to be screwed or attached in an installation space, for example an engine compartment of a passenger car.

FIG. 5 shows the second side cover 4 from FIG. 1*a* in a further perspective. Two junctions 17 are illustrated via which fluid can flow to or from the pump chamber. In one region of the side cover, lying opposite the stator cores (not illustrated) at least one nonmagnetic material is provided as the material. For example, that region over which the combination rotor passes is manufactured from a nonmagnetic material. The nonmagnetic material is preferably also electrically nonconductive. It is therefore possible to use not only ceramic or plastic bus also a nonmagnetic metal. The side cover can be manufactured, for example, as an injection molded part or else as a sintered component. It is therefore also possible for different materials to be used. An embodiment provides that the side cover 4 is manufactured jointly together with the stator cores. For this purpose, a sintering method can be used, such as is known, for example, from DE 10 2009 042 598 A1 and JP H08-134509 A, to which reference is made in this respect within the scope of the disclosure. While DE 10 2009 042 598 A1 and JP H08-134509 A disclose how, for example, identical or even different sintered materials can be produced together, DE 10 2009 042 603 A1 discloses how prefabricated components can be introduced precisely into one component to be sintered. The latter is possible, for example, for manufacturing the stator with, for example, prefabricated stator cores made, for example, from sintered material, as in the case of the use of electric plates as soft-magnetic elements in the combination rotor for manufacturing a reluctance motor. Magnets can also be introduced in this way, wherein owing to the temperatures during sintering they can also preferably be firstly inserted after the sintering.

FIG. 6 shows an exemplary embodiment of a second version of a further third side cover 18. The third side cover 18 has, for example, soft magnetic poles 19 which are preferably manufactured from Soft Magnetic Composites. These can extend, for example as illustrated, as far as a surface and therefore also form an edge of the inner housing. Such a design has the advantage that the side cover can otherwise be manufactured from nonmagnetic material, for example from metallic powder by means of a sintering process.

The proposed fluid pump can be used in different fields of application. Fluids of a wide variety of types such as Newtonian or Bingham fluid, as well as also gas can be transported. The use can comprise a wide variety of fields such as the chemical industry, the food stuff industry, use in machines and installations as well as also in the field of vehicles, aircraft and shipping. The fluids can comprise alkaline solutions or acids, can act corrosively and can be cooled or heated. The following examples are given only by way of example without being conclusive:

An oil pump in an internal combustion engine; circulation pump, for example in a coolant circuit or else in the field of heating; as a circulation pump, for example in drinking water systems; lubricant pump; as a hydraulic clutch actuator; in a fuel feed system; in the injection system in the region of the common rail in a gasoline or even diesel direct injection system; as an air-conditioning compressor; as a vacuum pump; as a servo pump, for example in the field of power steering systems; in a brake boosting system; in transmissions, in particular automatic transmissions, for example for the purpose of cooling, for maintaining a pressure, as a suction pump; in the field of aquariums; in PC and server cooling systems such as, for example, in a water cooling system; in medical technology, for example in a dialysis device, an infusion pump, an insulin pump; in an exhaust gas post-treatment system, for example for feeding in a urea; as a venting pump; in brake boosters, for filling pneumatic actuators; in active chassis; in windshield cleaning systems or headlight cleaning systems; in washing systems; as a submersible pump; as a drive pump in hydraulic machines; in a hybrid drive, for example of a vehicle.

The invention claimed is:

1. A fluid pump, driven by an electric motor which is coupled to a combination rotor serving as a pump rotor of the fluid pump, wherein the electric motor is an axial flux electric motor, in which the combination rotor also serves as an electric motor rotor for the axial flux electric motor, and the combination rotor serving as the pump rotor and the electric motor rotor is accommodated in a common housing in which the pump rotor and the electric motor rotor rotate in an integrated fashion in a shape of a disk as the combination rotor, wherein the common housing has a fluid inflow and a fluid outflow to and from the combination rotor; and in that a first stator of the axial flux electric motor surrounds the combination rotor on a first end side, and a second stator of the axial flux electric motor surrounds the combination rotor on a second end side, opposite the first end side, of the common housing; wherein a first set of cores of the first stator and a second set of cores of the second stator lie opposite one another, offset in a circumferential direction with respect to one another and axis-parallel with respect to a rotational axis of the combination rotor and wherein such offset results in the cores being non-coaxial among the first and second sets.

2. The fluid pump as claimed in claim 1, wherein a pump chamber and magnets or soft-magnetic elements of the axial flux electric motor, which are oriented axially with respect to the rotational axis of the combination rotor, are arranged extending from said rotational axis when viewed in a radial direction.

3. The fluid pump as claimed in claim 1, wherein in the combination rotor, a multiplicity of axially oriented magnets or soft-magnetic elements are distributed along a circumference of the combination rotor.

4. The fluid pump as claimed in claim 1, wherein at least one of the first and second stator of the axial flux electric motor is arranged at the first or the second end sides with respect to the combination rotor, wherein the cores of the at least one of the first and second stator, which are oriented axis-parallel with respect to the rotational axis of the combination rotor, have at least partially a soft-magnetic material.

5. The fluid pump as claimed in claim 4, wherein the common housing has a nonmagnetic material, at least in a region between the combination rotor and the cores of at least one of the first and second stator.

6. The fluid pump as claimed in claim 1, wherein a pump chamber is closed off in the common housing, and the fluid inflow and/or the fluid outflow to and from the pump chamber occurs axially along the rotational axis through the axial flux electric motor.

7. The fluid pump as claimed in claim 1, wherein the combination rotor has a co-rotating pump wheel which rotates with the combination rotor, wherein a shaft of the combination rotor is arranged and mounted inside the common housing.

8. The fluid pump as claimed in claim 1, wherein the combination rotor rotates about a rotational axis in the common housing, wherein a co-rotating pump wheel which rotates, with the combination rotor is seated on the rotational axis.

9. The fluid pump as claimed in claim 1, wherein a first and a second shaft end of a shaft or of the rotational axis of the combination rotor respectively end in the common housing.

10. A method for manufacturing a fluid pump, having the following steps:

manufacturing a combination rotor as a pump rotor and an electric motor rotor of a disk design with axial arrangement of magnets or soft-magnetic elements in the combination rotor; wherein a first stator of an axial flux electric motor surrounds the combination rotor on a first end side, and a second stator of the axial flux electric motor surrounds the combination rotor on a second end side, opposite the first end side, of a common housing; wherein a first set of cores of the first stator and a second set of cores of the second stator lie opposite one another, offset in a circumferential direction with respect to one another and axis-parallel with respect to a rotational axis of the combination rotor and wherein such offset results in the cores being non-coaxial among the first and second sets, insertion of the combination rotor into an outer ring, insertion of a shaft or axle, lateral attachment of at least one side wall to the outer ring to provide fluid-tight sealing of the combination rotor accommodating an end of the shaft or axle in the at least one side wall, lateral attachment of at least one of the first or second stator of the axial flux electric motor to the at least one side wall in order to drive the combination rotor in the common housing by at least the outer ring and the at least one side wall, wherein the cores of the first and second stator are arranged axis-parallel with respect to the rotational axis of the combination rotor.

11. The method as claimed in claim 10, wherein the cores of the first or second stator are pressed and manufactured from a soft-magnetic material.

* * * * *